US011986041B2

(12) United States Patent
Polstein et al.

(10) Patent No.: US 11,986,041 B2
(45) Date of Patent: May 21, 2024

(54) PROTECTIVE SPORTS FACE MASK

(71) Applicant: Clearview Systems, LLC, Orlando, FL (US)

(72) Inventors: Michael Polstein, Orlando, FL (US); Jason Polstein, Orlando, FL (US); Matthew Polstein, Orlando, FL (US)

(73) Assignee: Clearview Systems, LLC, Orlando, FL (US)

( * ) Notice: Subject to any disclaimer, the term of this patent is extended or adjusted under 35 U.S.C. 154(b) by 169 days.

(21) Appl. No.: 17/737,633

(22) Filed: May 5, 2022

(65) Prior Publication Data

US 2022/0354204 A1 Nov. 10, 2022

Related U.S. Application Data

(60) Provisional application No. 63/185,094, filed on May 6, 2021.

(51) Int. Cl.
*A42B 3/20* (2006.01)

(52) U.S. Cl.
CPC ..... *A42B 3/20* (2013.01)

(58) Field of Classification Search
CPC ..... A42B 3/20; A63B 2243/007; A63B 71/10
See application file for complete search history.

(56) References Cited

U.S. PATENT DOCUMENTS 3,319,261 A * 5/1967 051967 ..... A42B 3/20 2/9
4,631,758 A * 12/1986 Newman ..... A42B 3/20 2/9
5,477,565 A * 12/1995 Hunt, Jr. ..... A42B 3/20 2/424
D448,528 S * 9/2001 Fujimoto ..... D29/111
6,499,139 B1 * 12/2002 Brown ..... A63B 71/10 2/9
6,763,524 B2 7/2004 Halstead et al.
6,934,971 B2 * 8/2005 Ide ..... A42B 3/08 2/9
6,938,272 B1 9/2005 Brown
6,983,487 B2 1/2006 Rickon
D517,250 S 3/2006 Polstein
7,430,763 B1 * 10/2008 Santos ..... A42B 3/20 2/9
D602,647 S 10/2009 Polstein et al.
D603,102 S 10/2009 Polstein et al.
(Continued)

FOREIGN PATENT DOCUMENTS

EP 3626098 A1 * 3/2020 ..... A42B 3/20
WO WO-2020092629 A1 * 5/2020 ..... A42B 3/00

*Primary Examiner* — Alissa L Hoey

(74) *Attorney, Agent, or Firm* — Baker Donelson; Carl M. Davis, II

(57) ABSTRACT

A face mask comprising a U-shaped headband for securing to a player's head and a wire cage attached to the headband to provide resistant to impact by balls having a spaced-apart upper bar, intermediate bar and lower bar, interconnected by a pair of opposing side bars and a front bar, which upper bar, intermediate bar, and front bar each comprising flattened wire members having in cross-section opposing curved surfaces and opposing flat surfaces and having one of the curved surfaces facing a first outward direction and the flat faces facing in opposing lateral directions.

17 Claims, 5 Drawing Sheets

(56) References Cited

U.S. PATENT DOCUMENTS

| | | | | |
|---|---|---|---|---|
| 7,836,517 | B2 * | 11/2010 | Durocher | A42B 3/20 2/9 |
| 9,591,884 | B2 * | 3/2017 | Jurga | A42B 3/205 |
| 9,675,128 | B2 * | 6/2017 | Allen | A42B 3/20 |
| 9,731,185 | B2 * | 8/2017 | Hsu | A63B 69/02 |
| 10,306,944 | B1 * | 6/2019 | Ratliff | A42B 3/20 |
| 11,039,654 | B2 * | 6/2021 | Hsu | A63B 71/10 |
| 11,172,722 | B2 * | 11/2021 | Sumelius | A42B 3/20 |
| 11,590,028 | B2 * | 2/2023 | Hayes | A42B 3/227 |
| 11,812,813 | B1 * | 11/2023 | Fogg | A63B 71/10 |
| 11,813,509 | B1 * | 11/2023 | Reynolds | A42B 3/20 |
| 2007/0044193 | A1 * | 3/2007 | Durocher | A42B 3/20 2/9 |
| 2007/0214537 | A1 * | 9/2007 | Durocher | A42B 3/20 2/9 |
| 2007/0250990 | A1 | 11/2007 | Brown et al. | |
| 2007/0250992 | A1 * | 11/2007 | Brown | A42B 3/20 2/424 |
| 2007/0266471 | A1 * | 11/2007 | Lin | A63B 71/10 2/9 |
| 2009/0044316 | A1 | 2/2009 | Udelhofen | |
| 2011/0225708 | A1 * | 9/2011 | Polstein | A63B 71/10 2/425 |
| 2012/0210482 | A1 * | 8/2012 | Polstein | A63B 71/10 2/9 |
| 2016/0029733 | A1 * | 2/2016 | Kovarik | A42B 3/20 2/424 |
| 2020/0138141 | A1 * | 5/2020 | Kwok | A42B 3/128 |
| 2021/0069020 | A1 * | 3/2021 | Hayes | A61F 9/045 |
| 2021/0227919 | A1 * | 7/2021 | Morgan | A42B 3/08 |
| 2021/0378343 | A1 * | 12/2021 | Riegle | A42B 3/205 |
| 2022/0061448 | A1 * | 3/2022 | Withnall | A42B 3/20 |
| 2022/0248795 | A1 * | 8/2022 | Kim | A42B 3/20 |

* cited by examiner

PROTECTIVE SPORTS FACE MASK

TECHNICAL FIELD

The present invention relates to protective headgear face masks for players to wear during play of sports events. More particularly, the present invention relates to protective cage face masks having increased resistance to forces from impact of balls hit to the face of a player wearing the headgear during play of sports events.

BACKGROUND OF THE INVENTION

Many sports activities, particularly, team sports such as softball, involves thrown or batted balls. A ball involved in these sports can be driven by the batter to a high velocity. Quickness and alertness are key factors for players in the field successfully catching or stopping the ball in flight. Sometimes the players are hit by the batted ball. This may happen when the player misjudges the flight path or the velocity of the ball, but in some instances, the event of the pitched ball being hit at high velocity occurs so quickly that the player is unable to defend against being hit. Balls that hit on the arms, legs or body of a player may be painful and potentially cause injury, but hits that impact the player's face are of more concern due to risk of injury to eyes, nose, mouth and teeth, and facial bones.

The development of batting technology—better bats that lead to better (i.e., harder) hits and combined with focused coaching and practice that increases the skill of the players—increases the potential impact force that may be experienced by a player hit by a batted ball. Players with less experience or less responsiveness to play actions may be more susceptible to being hit with a quickly moving ball driven by a more experienced, stronger player.

Equipment has been developed over the years to provide protection while still allowing for player's enjoyment of the play of the game. This equipment includes batting and fielding hand gloves, chest protection garments worn underneath jerseys, shin guards, and face masks. Face masks provide a protective structure that positions over the face, typically from a forehead to chin and below, for blocking hard hit balls from impacting on the player's face. The structure thereby has two competing requirements. The face mask provides a blocking structure that can withstand and absorb impact forces yet the face blocking structure preferably does not interfere to the extent possible with a player's view of the ball field directly in front as well as to the lateral and peripheral sides.

Face masks have been developed for positioning over the face for protection from impact by the sports balls during play. The face masks include molded plastic shields, wire cage structures, and combinations. Wire cage structures configure spaced and secured wires to form an outward cage. Elastic and adjustable head straps engage the face masks and encircle the back and top of the players' head to hold the face mask structure in protecting position.

With the increasing skills and technology, there remains a need in the industry for a face mask having resistance to forces from impact of batted balls that fly to the face of a sports player. It is to such that the present invention is directed.

BRIEF SUMMARY OF THE PRESENT INVENTION

The present invention meets the need in the art by providing a wire cage face mask, comprising a headband defining a U-shape forehead portion and opposing diverging side portions that extend to respective free distal ends and having a harness for securing the headband to a player's head and a wire cage attached to the headband, said wire cage extending forwardly to provide resistant to impact by balls. The wire cage comprises an upper bar attached to the headband on an outward face; an intermediate bar spaced from the upper bar and having opposing distal ends attached to the headband proximate the distal ends of the opposing side portions; a lower bar spaced from the intermediate bar and having opposing distal ends attached to the headband proximate the distal ends of the intermediate bar; a pair of lateral side bars attached at opposing distal ends to the lower bar and the upper bar and at an intermediate portion to the intermediate bar; and a front bar centrally attached at opposing ends to the lower bar and the intermediate bar. Said upper bar, intermediate bar, and front bar each comprising a flattened wire member having in cross-section opposing curved surfaces and opposing flat surfaces, said upper, intermediate, and front bars oriented to have a respective one of the curved surfaces facing a first outward direction relative to the u-shaped forehead portion of the headband and the respective flat faces facing in opposing lateral directions.

In another aspect, the present invention comprises a wire cage face mask, comprising a headband defining a U-shape forehead portion and opposing diverging side portions that extend to free distal ends and having a harness for securing the headband to a player's head; and a wire cage attached to the headband, said wire cage extending forwardly to provide resistant to impact by balls. The wire cage comprises an upper bar attached to the headband on an outward face; an intermediate bar spaced from the upper bar and having opposing distal ends attached to the headband proximate the distal ends of the opposing side portions; a lower bar spaced from the intermediate bar and having opposing distal ends attached to the headband proximate the distal ends of the intermediate bar; a pair of lateral side bars attached at opposing distal ends to the lower bar and the upper bar and at an intermediate portion to the intermediate bar; and a front bar centrally attached at opposing ends to the lower bar and the intermediate bar. Said at least one of the upper bar, intermediate bar, and front bar comprising a flattened wire member having opposing curved surfaces and opposing flat surfaces, said at least one of the upper, intermediate, and front bars oriented to have a respective one of the curved surfaces facing a first outward direction relative to the u-shaped forehead portion of the headband and the respective flat faces facing in opposing lateral directions.

In another aspect, the present invention provides a wire cage face mask, comprising a headband defining a U-shape forehead portion and opposing side portions that extend to free distal ends and having a harness for securing the headband to a player's head; and a wire cage attached to the headband, said wire cage extending forwardly to provide resistant to impact by balls. The wire cage comprises an intermediate bar spaced from the headband and having opposing distal ends attached proximate the distal ends of the opposing side portions; a lower bar spaced from the intermediate bar and having opposing distal ends attached to the headband proximate the distal ends of the intermediate bar; a pair of lateral side bars attached at opposing distal ends to the lower bar and the headband and at an intermediate portion to the intermediate bar; and a front bar centrally attached at opposing ends to the lower bar and the intermediate bar. Said at least one of the intermediate bar and front bar comprising a flattened wire member having opposing curved surfaces and opposing flat surfaces, said at least one of the intermediate bar and front bar oriented to have a respective one of the curved surfaces facing a first outward direction relative to the u-shaped forehead portion of the headband and the respective flat faces facing in opposing lateral directions.

Objects, advantages, and features of the present invention will become readily apparent upon a reading of the following detailed description with reference to the drawings.

DETAILED DESCRIPTION

Figure 1:
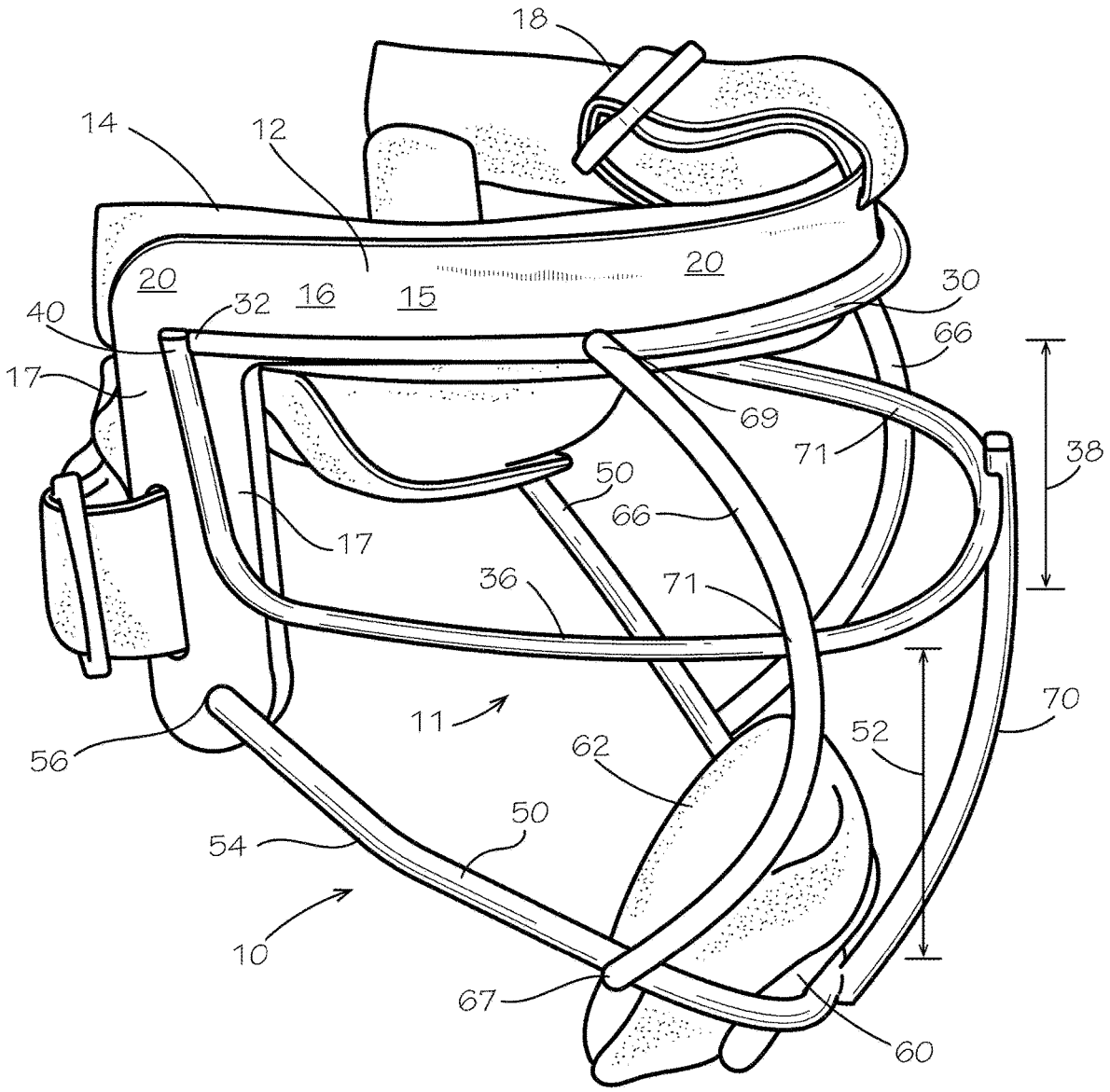
FIG. 1 illustrates a perspective view of a protective face mask according to the present invention.
Figure 2:
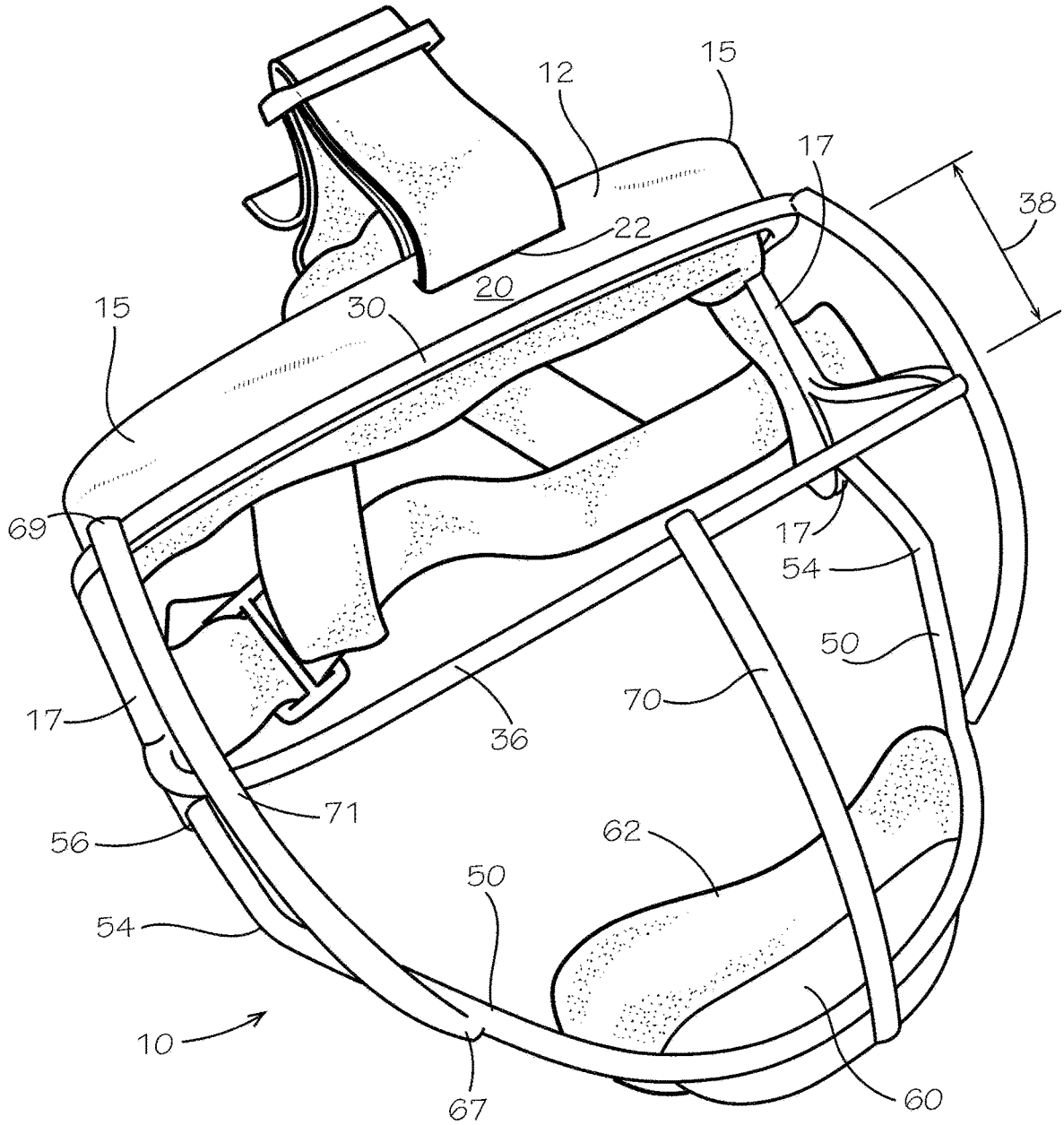
FIG. 2 illustrates a detailed front perspective view of the protective face mask illustrated in FIG. 1.

With reference to the drawings in which like parts have like identifiers, FIG. 1 illustrates a perspective view of a protective face mask 10 according to the present invention for protecting the face of a sports player during play and resisting forces from impact of balls that upon batting or being thrown fly to the face of the sports player. The face mask 10 provides a wire cage-type mask generally 11 for protecting the face of a player from direct impact by a ball during play of a sports event. The face mask 10 includes a head band 12 having an interior pad 14 for seating cushioningly against a player's forehead and head sides above the eyes and ears. The head band 12 is a flat elongated plate curved to define a U-shape of a forehead portion 20 and opposing side legs 16, 18 that divergingly curve away from each other and terminate in respective downwardly extending side plates 17, 19. The U-shape plate of the head band 12 extends around the forehead and at a corner point 15 extends as side legs 16, 18 on opposing sides of a player's head. The side legs 16, 18 extend rearwardly a length to position the side plates 17, 19 forwardly of an ear portion of a player's head, for example, intermediate the temple and ears of the player. The forehead portion 20 includes a slot or opening 22. The opposing side portions 16, 18 each include a respective slot or opening 24.

An upper bar 30 attaches to an outward face of the head band 12 along a bottom edge portion. The upper bar 30 extends to opposing distal ends 32. The opposing distal ends 32 attach to respective side portions of the head band 12 near distal ends of the leg portions 16, 18 remote from the U-shaped forehead portion 20. The wire-cage 11 includes an intermediate bar 36 vertically spaced 38 from the upper bar 30. The intermediate bar 36 extends transverse across a nose portion of a player's face between opposing distal ends 40. The vertical spacing 38 is substantially the same relative to a front portion of the upper bar and relative to the side legs 16, 18. In the illustrated embodiment, the intermediate bar 36 angles upwardly proximate a forward edge of the side plates 17, 19 on the respective sides to the distal ends 40. In the illustrated embodiment, the intermediate bar 36 secures along the side plates 17, 19 to the distal ends 40 proximate the distal ends 34 of the upper bar 32. The wire cage 11 includes a lower bar 50 vertically spaced 52 from the intermediate bar 36 in the mouth and chin area of a player's face. The lower bar 50 angles upwardly and outwardly for spacing outwardly along lower jaw lines of a player. The vertical spacing 52 is substantially the same across the front chin area of the face but tapers narrowingly along the angled line of the lower bar 50 towards the rear of the face mask. The lower bar 50 extends from the central chin area to an arc point 54 intermediate the forward chin area and the side plate 17, 19 that is proximate a back edge of a player's jaw. The lower bar 50 angles upwardly and outwardly on the respective sides to the distal ends 56. The distal ends 56 secure to a lower portion of the respective side plates 17, 19.

A chin plate 60 attaches centrally on an inward side of the lower bar 50. A chin pad 62 detachably attaches to the chin plate 60 for cushioningly abutting a lower jaw/chin area of the face of a player wearing the face mask 10. In the illustrative embodiment, a sheet has an adhesive on a first surface and a plurality of hook members extending from an opposing surface. The adhesive secures the sheet to an interior face of the chin plate 60. The chin pad 62 conventionally defines a recess on an interior side and the opposing side includes extending loop fabric that detachably attaches to the hooks.

A pair of lateral side bars 66 attach at a first end 67 to the lower bar 50 intermediate the chin plate 60 and the arc point 54 and attach at an opposing second end 69 to the upper bar 30 proximate the curved corner 15 of the forehead plate 20 transitioning into the rearwardly extending legs 16, 18. The curved corner 15 corresponds to a temple portion of a player's head between a front portion and rearwardly extending side portion of the head band 12. The side bars 66 extend across and further secure 71 to the intermediate bar 36.

A front bar 70 attaches at a first end to the lower bar 50 medial the lateral edges of the chin plate 60 and attaches at a second end to the intermediate bar 36.

Figure 3:
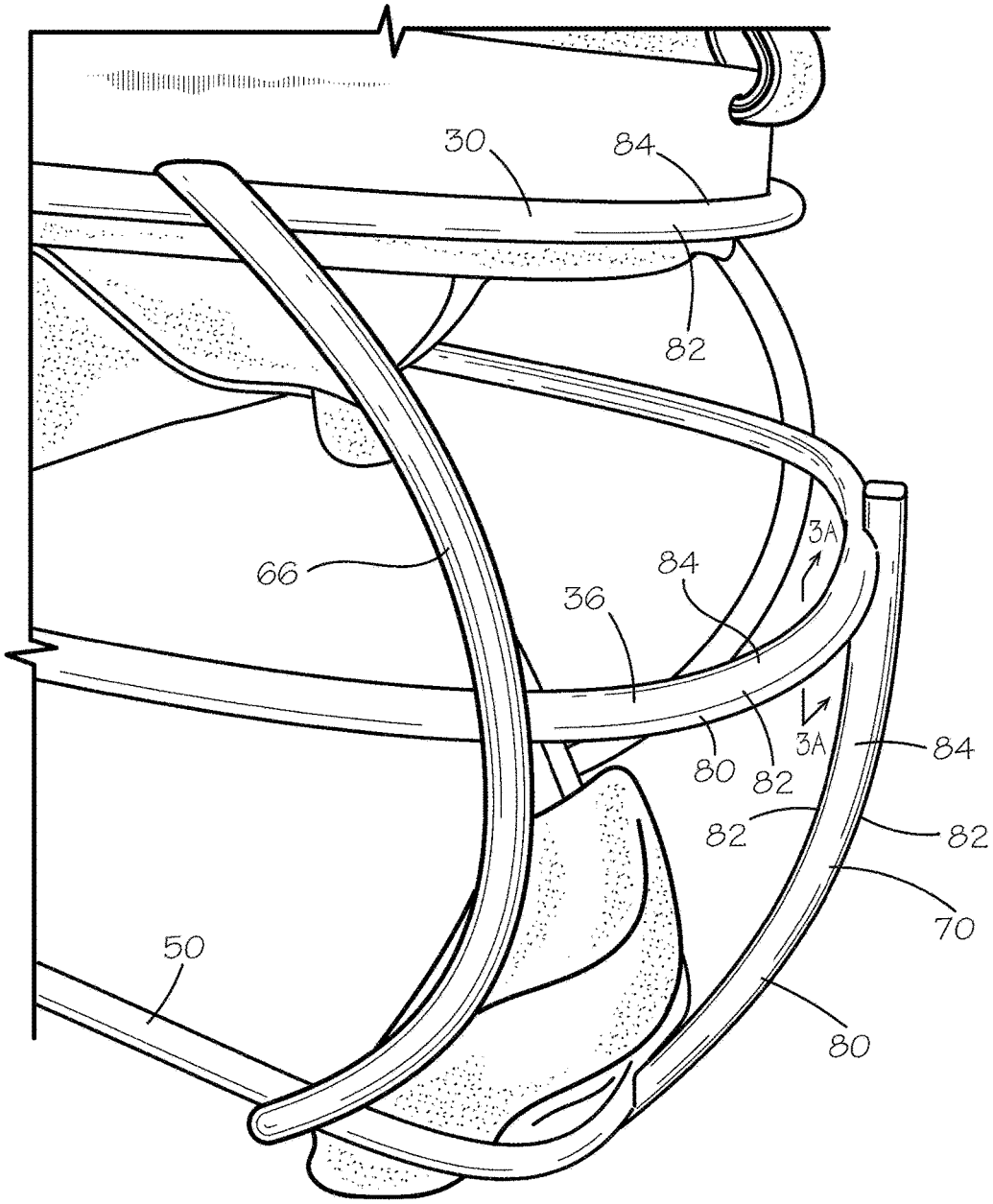
FIG. 3 illustrates a second detailed front perspective view of the protective face mask illustrated in FIG. 1.
Figure 3A:
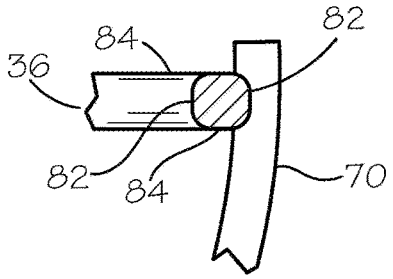
FIG. 3A illustrates a detailed view of a portion of the protective face mask showing a first wire member and a second wire member of the cage for the protective face mask illustrated in FIG. 3.

The face mask 10 in accordance with the present invention uses lengths of a flattened wire 80 for at least the intermediate bar 36, more preferably, for the intermediate bar 36 and front bar 70, and the illustrated embodiment shown in a second detailed perspective view in FIG. 3 uses lengths of the flattened wire 80 for the upper bar 30, the intermediate bar 36, and the front bar 70. FIG. 3A illustrates in detailed view a portion of the protective face mask showing a first flattened wire member for the intermediate bar 36 and a second flattened wire member for the front bar 70 of the cage 11 for the protective face mask 10 illustrated in FIG. 3. The flattened wire 80 has opposing curved sides 82 and opposing flat sides 84. The flattened wire 80 is oriented with one of the curved sides 82 outwardly. For the upper bar 30 and the intermediate bar 36, the opposing flat sides 84 face upwardly and downwardly. The opposing flat faces 84 of the wire for the front bar 70 face laterally in opposing side directions. The lower bar 50 and the side bars 66 in the illustrated embodiment are lengths of wire circular in cross-section. In an alternate embodiment, the side bars 66 and/or the lower bar 50 may also be lengths of the flattened wire stock.

Figure 4:
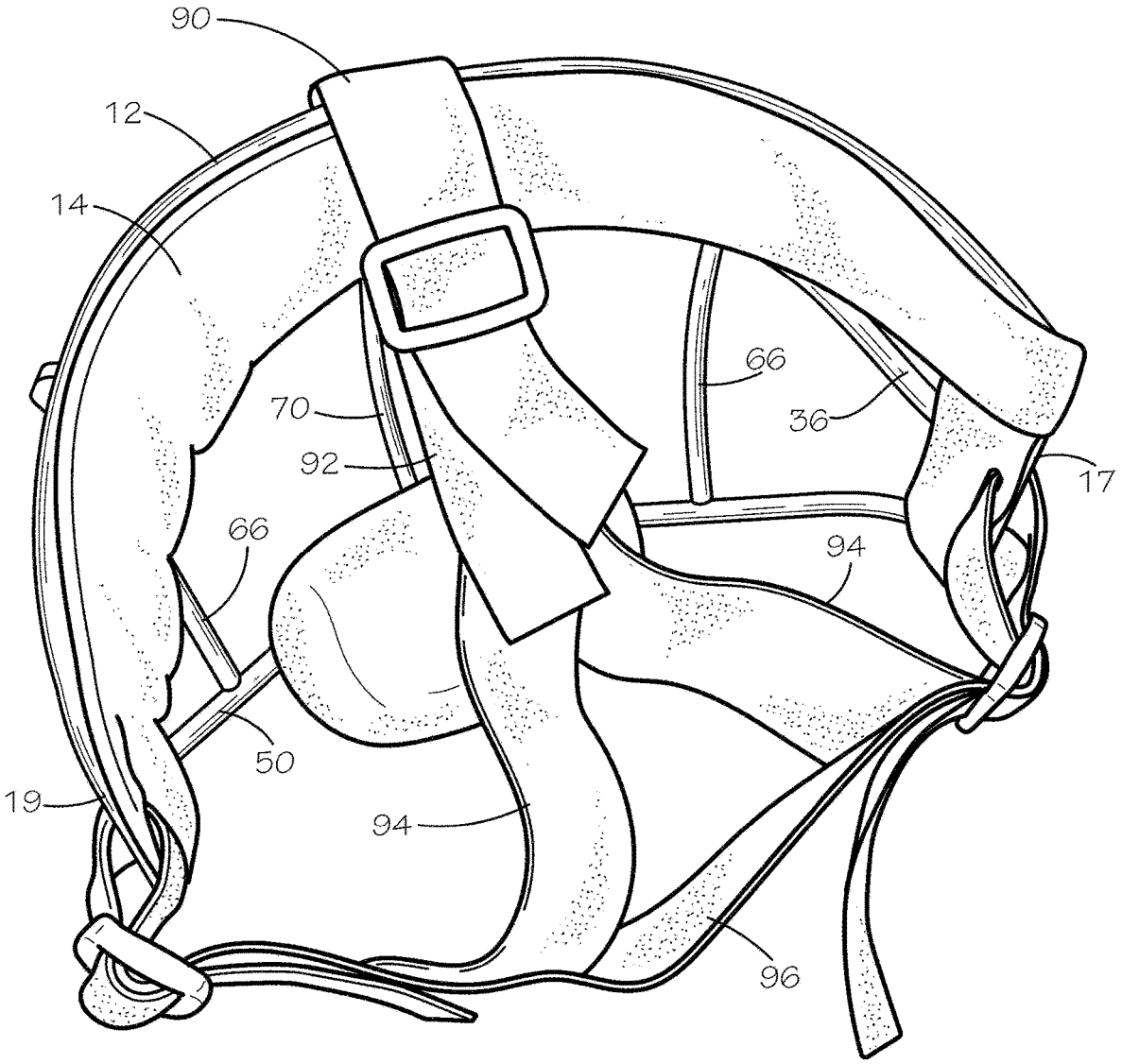
FIG. 4 illustrates an upper left perspective rear view of the protective face mask illustrated in FIG. 1.

With reference to FIG. 4, the face mask 10 secures to a player's head with adjustable straps. An upper strap 90 includes an elongated medial strap 92 that attaches at a first end to the slot 22. In the illustrated embodiment, the elongated medial strap 92 terminates at a back portion with a connection to a pair of elongated transition straps 94. The transition straps 94 attach to the strap 92 at a respective angle to define a Y-shape for the upper strap 90. A back strap 96 attaches at opposing ends with loops through the side slots 24. The distal ends of the transition straps 94 connect to the back strap 96. The straps 92, 94 preferably are adjustable with conventional buckles or adjustable slide members for adjustably seating the face mask 10 on the head of the player. The face mask 10 seats on the face with a lower edge of the head band 12 above the eyes and ears of the player wearing the face mask.

An illustrative embodiment of the face mask 10 suitable for youth players uses a ¾ inch wide metal band for the head band 12. The U-shape head band 12 has a length of 4½ inches from an apex to a plane defined by the opposing distal ends. The side legs 16, 18 curve divergingly outwardly to position the legs with the opposing distal ends 6¾ inches apart. The cushion pad 14 tapers from 1 inch thickness at the apex to ¼ inch thickness at the distal ends of the side legs 16, 18. The cushion pad 14 may be covered with a smooth or non-abrasive fabric.

Figure 5:
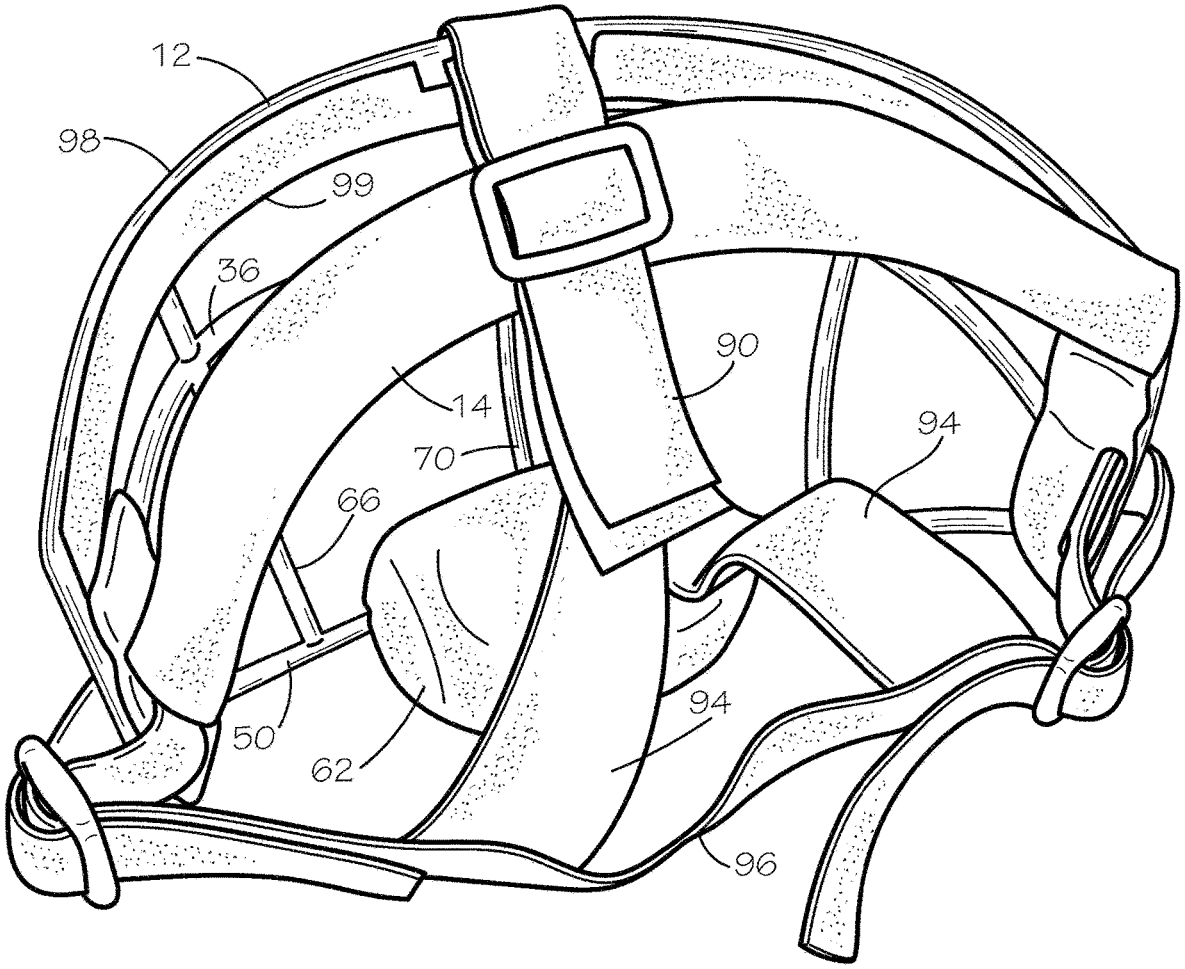
FIG. 5 illustrates an upper left partially exploded rear view of the protective face mask illustrated in FIG. 1.

FIG. 5 illustrates an upper left partially exploded rear view of the protective face mask 10 illustrated in FIG. 1. An inside face 98 of the headband 12 includes an attaching strip 99 such as a hook material. The strip 99 adhesively attached on a first surface to the inside face 98 and an opposing surface includes a plurality of extending hooks. The hooks detachable engage the cushion pad 14.

The wire cage 11 in accordance with the present invention assembles with lengths of a round wire for the lower bar 50 and the lateral side bars 66. The cage 11 uses lengths of a flattened wire 80 for the upper bar 30, the intermediate bar 36, and the front bar 70. In an illustrative embodiment, the round wire has a diameter of 4.8 mm and the flattened wire 80 has a length of 5.5 mm between the opposing curved sides 82 and a width of 3.7 mm between the opposing flat sides 84. The unit mass of the flattened wire in this embodiment exceeds the unit mass of the round wire. The unit mass of the flat wire; 5.5 mm×3.7 mm=20.35 sq mm. The unit mass of the round wire, 4.8 mm×3.14=15.07 sq mm. The unit mass of the flattened wire in this embodiment exceeds that of the round wire by 26%, in that 15.07 sq mm/20.35 sq mm=0.74. The flattened wire bars 30, 36, and 70 are thus stronger by unit mass alone. Further, the structure of the present invention orienting the bars with the flatted wire with the arcuate surface 82 outward for initial resistance to ball impact forces provides additional "yield strength" resistance of 10%-15%. The yield strength resistance arises from the resistance of the respective flattened bar to bend on a longitudinal line along an axis of the impact force of the ball on the flattened wire bar.

A second illustrative embodiment uses a round wire having a 5.5 mm diameter. The round wire is flattened as shown in FIG. 3 to provide a flattened wire for the upper bar 30, the intermediate bar 36 and the front bar 70. As a result of the flattening process, the flattened wire 80 in this embodiment has a length exceeding 5.5 mm between the opposing curved sides 82 and a width of 3.7 mm between the opposing flat sides 84. The unit mass of the wire members used in this embodiment is equal. However, the structure of the wire cage that orients the bars with the flatted wire with the arcuate surface 82 outwardly for initial resistance to ball impact forces provides additional "yield strength" resistance of 10%-15%. The yield strength resistance arises from the resistance of the respective flattened bar to bend on a longitudinal line along an axis of the impact force of the ball on the flattened wire bar.

Embodiments of the present invention may have wire members made of flattened wire having a cross-sectional length of between about 5 mm and 7 mm between the opposing curved surfaces and a cross-sectional width of about 3 mm to 4 mm between the opposing flat surfaces. Preferably, the unit mass of the flattened wire exceeds the unit mass of the circular wires used in constructing cages 11 in accordance with the present invention.

An embodiment of the present invention provides a wire cage face mask 10, comprising a headband 12 defining a U-shape forehead portion and opposing side portions 16, 18 that extend to free distal ends and having a harness for securing the headband to a player's head; and a wire cage 11 attached to the headband, said wire cage extending forwardly to provide resistant to impact by balls. The wire cage 11 comprises an intermediate bar 36 spaced from the headband and having opposing distal ends attached proximate the distal ends of the opposing side portions; a lower bar 50 spaced from the intermediate bar 36 and having opposing distal ends attached to the headband proximate the distal ends of the intermediate bar; a pair of lateral side bars 66 attached at opposing distal ends to the lower bar 50 and the headband 12 and at an intermediate portion to the intermediate bar 36; and a front bar 70 centrally attached at opposing ends to the lower bar 50 and the intermediate bar 36. Said at least one of the intermediate bar and front bar comprising a flattened wire member having opposing curved surfaces and opposing flat surfaces, said at least one of the intermediate bar and front bar oriented to have a respective one of the curved surfaces facing a first outward direction relative to the u-shaped forehead portion of the headband and the respective flat faces facing in opposing lateral directions.

Embodiments of headgear in accordance with the present invention meet impact tests that evaluate the reduction of the acceleration of the player's head, and the headgear to remain in place, during impact. See NOCSAE Document ND021-18m19a entitled "*Standard Projectile Impact Testing Method and Equipment Used in Evaluating the Performance Characteristics of Protective Headgear, Faceguards or Projectiles*," modified June 2019.

It thus is seen that the foregoing describes a protective wire cage sports face for protecting the face of a sports player during play and resisting forces from impact of balls that upon batting or being thrown fly to the face of the sports player. Although the protective wire cage sports face has been illustrated and described in various embodiments, it should be understood that many modifications, additions, and deletions may be made without departure from the scope of the invention as set forth in the claims.

What is claimed is:

1. A wire cage face mask, comprising:

a headband defining a U-shape forehead portion and opposing diverging side portions that extend to respective free distal ends and having a harness for securing the headband to a player's head; and a wire cage attached to the headband, said wire cage extending forwardly to provide resistant to impact by balls, comprising:

an upper bar attached to the headband on an outward face;

an intermediate bar spaced from the upper bar and having opposing distal ends attached to the headband proximate the distal ends of the opposing side portions;

a lower bar spaced from the intermediate bar and having opposing distal ends attached to the headband proximate the distal ends of the intermediate bar;

a pair of lateral side bars attached at opposing distal ends to the lower bar and the upper bar and at an intermediate portion to the intermediate bar; and a front bar centrally attached at opposing ends to the lower bar and the intermediate bar;

said upper bar, intermediate bar, and front bar each comprising a flattened wire member having in cross-section opposing curved surfaces and opposing flat surfaces, said upper, intermediate, and front bars oriented to have a respective one of the curved surfaces facing a first outward direction relative to the u-shaped forehead portion of the headband and the respective flat faces facing in opposing lateral directions.

2. The wire cage face mask as recited in claim 1, wherein said lower bar and said side bars each comprise a non-flattened wire; and said flattened wire has a first unit mass exceeding a unit mass of the said non-flattened wire.

3. The wire cage face mask as recited in claim 2, wherein said non-flattened wire is circular in cross-section.

4. The wire cage face mask as recited in claim 1, wherein the flattened wire has a cross-sectional length between about 5 mm and 7 mm between the opposing curved surfaces and a cross-sectional width of about 3 mm to 4 mm between the opposing flat surfaces.

5. The wire cage face mask as recited in claim 1, wherein the flattened wire has a cross-sectional length of about 5.5 mm between the opposing curved surfaces and a cross-sectional width of about 3.7 mm between the opposing flat surfaces.

6. The wire cage face mask as recited in claim 1, wherein the harness further comprising adjustable length straps for selectively adjusting the attachment of the face mask to a player's head.

7. The wire cage face mask as recited in claim 1, further comprising a cushion pad attached to an inner face of the headband.

8. A wire cage face mask, comprising:

a headband defining a U-shape forehead portion and opposing diverging side portions that extend to free distal ends and having a harness for securing the headband to a player's head; and a wire cage attached to the headband, said wire cage extending forwardly to provide resistant to impact by balls, comprising:

an upper bar attached to the headband on an outward face;

an intermediate bar spaced from the upper bar and having opposing distal ends attached to the headband proximate the distal ends of the opposing side portions;

a lower bar spaced from the intermediate bar and having opposing distal ends attached to the headband proximate the distal ends of the intermediate bar;

a pair of lateral side bars attached at opposing distal ends to the lower bar and the upper bar and at an intermediate portion to the intermediate bar; and a front bar centrally attached at opposing ends to the lower bar and the intermediate bar;

said at least one of the upper bar, intermediate bar, and front bar comprising a flattened wire member having opposing curved surfaces and opposing flat surfaces, said at least one of the upper, intermediate, and front bars oriented to have a respective one of the curved surfaces facing a first outward direction relative to the u-shaped forehead portion of the headband and the respective flat faces facing in opposing lateral directions.

9. The wire cage face mask as recited in claim 8, wherein the other of the at least one of the upper bar, intermediate bar, and front bar and the lower bar and side bars each comprise a non-flattened wire.

10. The wire cage face mask as recited in claim 9, wherein said flattened wire has a first unit mass exceeding a unit mass of the non-flattened wire.

11. The wire cage face mask as recited in claim 9, wherein said non-flattened wire is circular in cross-section.

12. The wire cage face mask as recited in claim 11, wherein the non-flattened wire is circular in cross-section.

13. The wire cage face mask as recited in claim 8, wherein the flattened wire has a cross-sectional length between about 5 mm and 7 mm between the opposing curved surfaces and a cross-sectional width of about 3 mm to 4 mm between the opposing flat surfaces.

14. The wire cage face mask as recited in claim 8, wherein the flattened wire has a cross-sectional length between about 5.5 mm between the opposing curved surfaces and a cross-sectional width of about 3.7 mm between the opposing flat surfaces.

15. The wire cage face mask as recited in claim 8, wherein the harness further comprising adjustable length straps for selectively adjusting the attachment of the face mask to a player's head.

16. The wire cage face mask as recited in claim 8, further comprising a cushion pad attached to an inner face of the headband.

17. The wire cate face mask as recited in claim 8, further comprising a chin guard member attached centrally to the lower bar.

* * * * *